US006679742B2

(12) United States Patent
Yokoya et al.

(10) Patent No.: US 6,679,742 B2
(45) Date of Patent: Jan. 20, 2004

(54) EXHAUST STRUCTURE FOR A JET PROPULSION WATERCRAFT

(75) Inventors: Noboru Yokoya, Saitama (JP); Takayoshi Miura, Saitama (JP); Masahiko Tsuchiya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 2 days.

(21) Appl. No.: 10/178,735

(22) Filed: Jun. 25, 2002

(65) Prior Publication Data

US 2003/0013363 A1 Jan. 16, 2003

(30) Foreign Application Priority Data

Jul. 2, 2001 (JP) ..... 2001-200908

(51) Int. Cl.[7] ..... B63H 21/32
(52) U.S. Cl. ..... 440/89 J; 181/264
(58) Field of Search ..... 181/264; 440/89 R, 440/89 J

(56) References Cited

U.S. PATENT DOCUMENTS 6,305,493 B1 * 10/2001 Laimbock ..... 181/230

FOREIGN PATENT DOCUMENTS

JP 2000-282840 10/2000

* cited by examiner

*Primary Examiner*—Ed Swinehart
(74) *Attorney, Agent, or Firm*—Birch, Stewart, Kolasch & Birch, LLP

(57) ABSTRACT

To provide an exhaust structure for a jet propulsion watercraft which can simply achieve a reduction of the exhaust noise. In the exhaust structure for a jet propulsion watercraft, a water jet propeller is provided in a pump room of a watercraft body. An engine for driving the watercraft is connected to the water jet propeller. An exhaust opening of an exhaust pipe is attached to the engine and is exposed to a pump room. A resonator for sound deadening is provided for the exhaust pipe. Further, in the exhaust structure for a jet propulsion watercraft, the resonator is bent in a meandering state such that bent portions thereof are positioned adjacent to each other so that the entire resonator has a substantially flat plate-like configuration. The resonator having a plate-like configuration is laid along a ceiling wall of the pump room.

24 Claims, 10 Drawing Sheets

EXHAUST STRUCTURE FOR A JET PROPULSION WATERCRAFT

CROSS-REFERENCE TO RELATED APPLICATIONS

The present application claims priority under 35 USC 119 to Japanese Patent Application No. 2001-200908 filed on Jul. 2, 2001 the entire contents thereof is hereby incorporated by reference.

BACKGROUND OF THE INVENTION

1. Field of the Invention

This invention relates to an exhaust structure for a jet propulsion watercraft wherein a water jet propeller is provided in a pump room of a watercraft body and an exhaust pipe is connected to the pump room so that exhaust gas of an engine is exhausted into the pump room.

2. Description of Background Art

A jet propulsion watercraft is a watercraft wherein a water jet pump is attached to a rear portion of a watercraft body and is driven by an engine to take in water from the watercraft bottom. The water taken in is expelled rearwardly to propel the watercraft.

A jet propulsion watercraft is disclosed, for example, in Japanese Patent Laid-Open No. 2000-282840 entitled "Exhaust Structure for a Jet Propulsion Watercraft." The official gazette discloses a device for reducing the exhaust noise generated from a jet propulsion watercraft. According to this technique, a resonator for sound deadening is provided for an exhaust pipe connected to an engine, and the exhaust noise is caused to resonate by the resonator to deaden the exhaust noise so that a reduction in the exhaust noise can be achieved.

Incidentally, in a jet propulsion watercraft, in order to prevent water from entering the engine side from an exhaust opening of an exhaust pipe, it is necessary to form part of the exhaust pipe in a substantially U-shaped. By forming part of the exhaust pipe in a substantially U-shape, the length of the exhaust pipe becomes comparatively long. In addition, in order to allow for resonation with the exhaust noise of the elongated exhaust pipe, it is necessary to set the length of the resonator comparatively long in accordance with the length of the exhaust pipe.

Accordingly, in order to attach the long resonator in the inside of the watercraft body, it is necessary to assure a sufficient accommodation space in the inside of the watercraft body.

However, the inside space of the watercraft body is limited, and in order to assure a comparatively great accommodation space for a resonator in the limited space, it is necessary to sufficiently examine the layout of various watercraft accessories to be attached in the inside of the watercraft body.

Therefore, in order to assure an accommodation space for a resonator, a comparatively long period of time for examination is required.

Further, when a resonator is formed from a comparatively long member, it is difficult to handle the resonator. This tendency remarkably appears particularly in such a limited space as the space in the inside of a watercraft body. Upon attachment of such a long resonator, in order to assure a high assembly operability of the resonator, some skill is required.

Meanwhile, as a countermeasure for the reduction of exhaust noise, a countermeasure of blocking exhaust noise to reduce the noise or the like may be used in addition to the deadening countermeasure by means of a resonator. However, it is considered that such other reduction countermeasures as blocking require a complicated configuration from the point of view of the structure of a jet propulsion watercraft and therefore have not been placed into practical use.

Therefore, it has been demanded to place into practical use a technique which can simply reduce exhaust noise of a jet propulsion watercraft.

SUMMARY AND OBJECTS OF THE INVENTION

Therefore, the object of the present invention resides in the provision of an exhaust structure for a jet propulsion watercraft which can simply achieve a reduction of the exhaust noise.

In order to solve the subject described above, according to the present invention, an exhaust structure for a jet propulsion watercraft is provided wherein a water jet propeller is positioned in a pump room of a watercraft body and an engine for driving is connected to the water jet propeller. An exhaust opening of an exhaust pipe attached to the engine is exposed to a pump room and a resonator for sound deadening is provided for the exhaust pipe. The resonator is bent in a meandering state such that bent portions thereof are positioned adjacent to each other so that the entire resonator has a substantially flat plate-like configuration.

The resonator is bent in a meandering state such that bent portions thereof are positioned adjacent to each other so that the entire resonator has a substantially flat plate-like configuration. Since compact formation of the resonator can be achieved through the formation of the entire resonator in a flat plate-like configuration, the resonator can be disposed in a comparatively small accommodation space.

Further, since the resonator can be formed compact, handling of the resonator can be simplified. Therefore, an attaching operation of the resonator can be simply performed without any skill.

Furthermore, since the resonator is bent in a meandering state, even if water should try to enter the resonator from the exhaust pipe side, the water cannot be admitted readily into the inside of the resonator when compared with another resonator which extends linearly.

According to the present invention, the exhaust structure for a jet propulsion watercraft includes a resonator having a flat plate-like configuration extending along a wall face of the watercraft body.

Here, generally a surplus space does not remain in the inside of a watercraft body because various watercraft accessories are attached. However, a space often remains in the proximity of a wall face of the watercraft body.

Thus, in the present invention, the resonator having the flat plate-like configuration is disposed such that it extends along a wall face of the watercraft body. Therefore, since a space remaining in the inside of the watercraft body can be utilized to attach the resonator, the resonator can be further simply attached.

According to the present invention, the exhaust structure for a jet propulsion watercraft includes a wall face of the watercraft body along which the resonator extends is a ceiling wall of the pump room, and an exhaust opening of a communicating pipe extending through the ceiling wall is communicated with the resonator extending along the ceiling wall.

The pump room is outside the watercraft body, and the resonator can be attached to the outside of the watercraft body by laying the resonator along the ceiling wall of the pump room. In addition, a space around the ceiling wall of the pump room remains as a dead space. Therefore, by laying the resonator along the ceiling wall of the pump room, the remaining dead space may be utilized to attach the resonator.

Further, since the resonator is attached to the outside of the watercraft body, there is no need to assure the accommodation space for accommodating the resonator in the inside of the watercraft body.

By laying the resonator along the ceiling wall of the pump room in this manner, the resonator can be further simply attached.

According to the present invention, the exhaust structure for a jet propulsion watercraft includes a water jet propeller and a reverse basket that are accommodated in the pump room. A sound insulating member is provided for both or one of the water jet propellers and the reverse baskets such that the pump chamber is closed.

Here, since the exhaust opening of the exhaust pipe is exposed to the pump room, exhaust gas is exhausted into the atmospheric air through the pump room. Therefore, it is a possible idea to insulate exhaust sound by closing up the pump chamber. Thus, in the present invention, exhaust sound is insulated by closing up the pump chamber with the sound insulating member.

It is to be noted that the pump room is outside the watercraft body, and the space of the pump room remains as a dead space. By making the most of the dead space, the insulating member can be simply attached.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, embodiments of the present invention are described with reference to the accompanying drawings.

Figure 1:
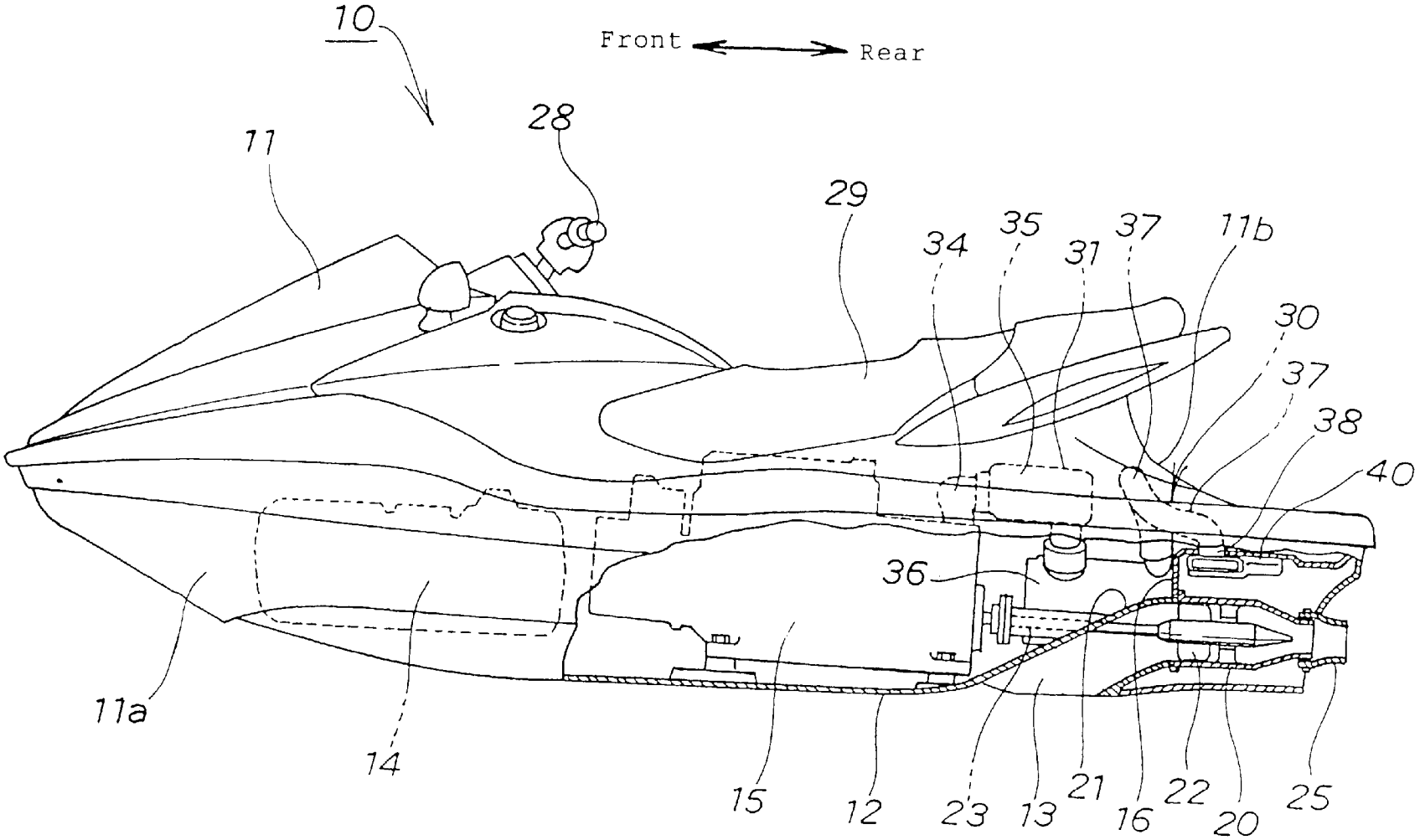
FIG. 1 is a side elevational view of a jet propulsion watercraft which includes an exhaust structure (first embodiment) according to the present invention.

FIG. 1 is a side elevational view of a jet propulsion watercraft which includes an exhaust structure (first embodiment) according to the present invention.

The jet propulsion watercraft 10 includes a fuel tank 14 attached to a front portion 11*a* of a watercraft body 11, an engine 15 provided rearwardly of the fuel tank 14 and a pump room 16 provided rearwardly of the engine 15. A water jet pump (water jet propeller) 20 is provided in the pump room 16 with an exhaust structure 30 for the jet propulsion watercraft attached on the intake side thereof to the engine 15 and on the exhaust side thereof to the pump room 16. A steering handle 28 is attached above the fuel tank 14 and a seat 29 is attached rearwardly of the steering handle 28.

The water jet pump 20 has a housing 21 extending rearwardly from an opening 13 of a watercraft bottom 12, and an impeller 22 is mounted for rotation in the housing 21 and connected to a drive shaft 23 of the engine 15.

With the water jet pump 20, when the engine 15 is driven to rotate the impeller 22, water taken in from the opening 13 of the watercraft bottom 12 can be jetted rearwardly of the watercraft body 11 from a steering pipe (steering nozzle) 25 through a rear end opening of the housing 21.

The steering pipe (steering nozzle) 25 is a member mounted for swinging movement in the leftward and rightward directions at a rear end of the housing 21. The steering nozzle 25 is a nozzle for steering which is swung in the leftward or rightward directions by an operation of the steering handle 28 to control the steering direction of the watercraft body 11.

With this jet propulsion watercraft 10, fuel is supplied from the fuel tank 14 into the engine 15 to drive the engine 15, and driving force of the engine 15 can be transmitted to the impeller 22 through the drive shaft 23 to rotate the impeller 22 to take in water from the opening 13 of the watercraft bottom 12 and jet the water taken in from the steering nozzle 25 through the rear end of the housing 21 to propel the jet propulsion watercraft 10.

Figure 2:
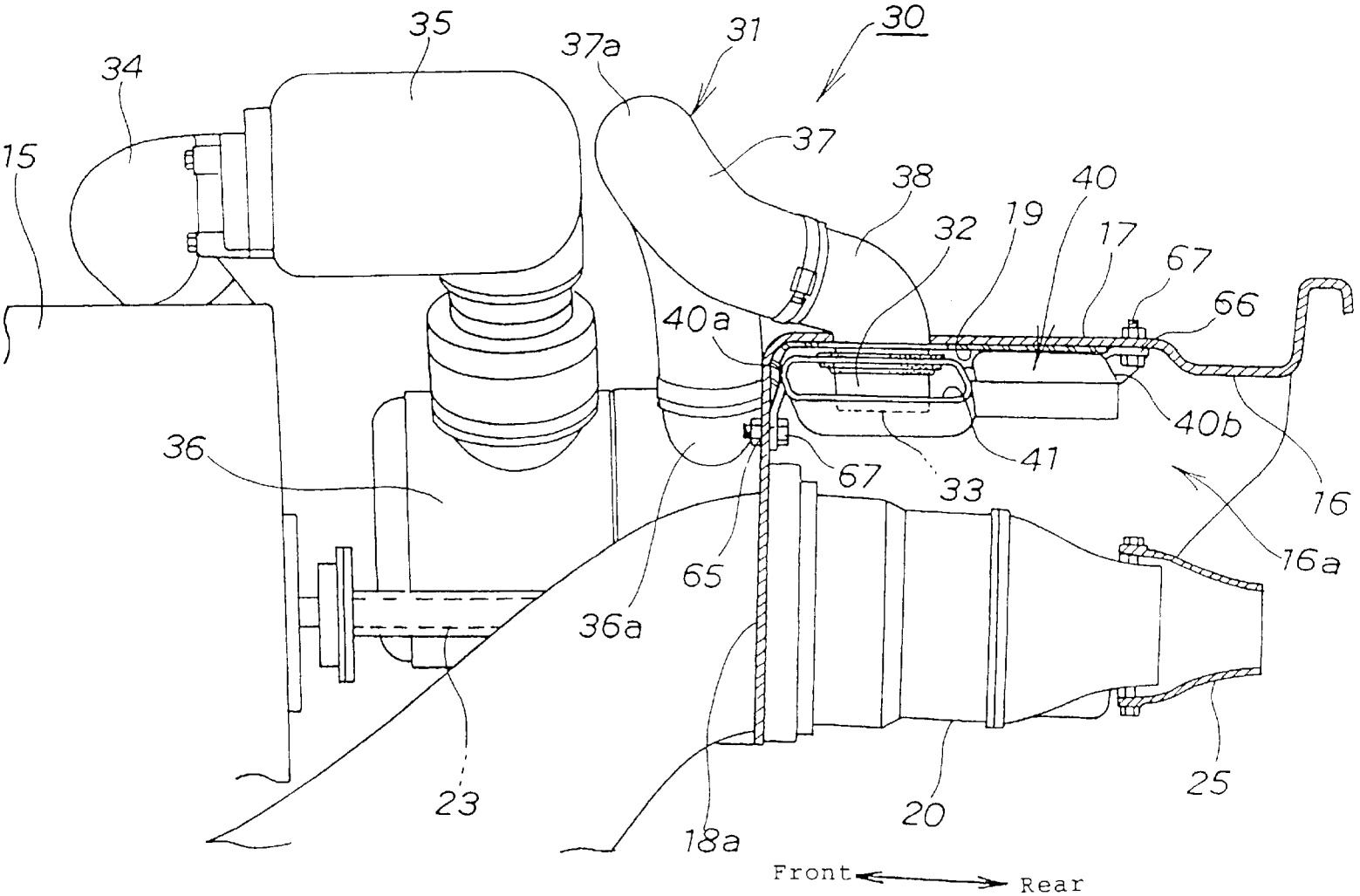
FIG. 2 is a side elevational view of another exhaust structure (second embodiment) for a jet propulsion watercraft according the present invention.

FIG. 2 is a side elevational view of the exhaust structure (first embodiment) for a jet propulsion watercraft according to the present invention.

According to the exhaust structure 30 for a jet propulsion watercraft, an exhaust gas pipe 31 is connected to an exhaust manifold (not shown) of the engine 15, and an end portion 32 of the exhaust gas pipe 31 is attached along a ceiling wall 17 of the pump room 16 (a wall face of the watercraft body).

A resonator 40 disposed on the ceiling wall 17 is connected to the end portion 32 of the exhaust gas pipe 31, and an exhaust opening 41 of the resonator 40 is exposed to an internal space 16*a* of the pump room 16.

Consequently, an exhaust opening 33 of the exhaust gas pipe 31 is in communication with the internal space 16*a* of the pump room 16 through the exhaust opening 41 of the resonator 40.

The exhaust gas pipe 31 includes an exhaust pipe 34 connected to the exhaust manifold, an exhaust body 35 connected to an exit of the exhaust pipe 34, a muffler 36 connected to the exit side of the exhaust body 35, a connecting pipe 37 connected to an exit 36*a* of the muffler 36, and a tail pipe 38 connected to an exhaust opening of the connecting pipe 37. An end portion 32 of the tail pipe 38 (that is, an end portion of the exhaust gas pipe 31) is attached to the ceiling wall 17 of the pump room 16.

The muffler 36 is a member disposed on the right side of the pump room 16 and has the exit 36*a* provided forwardly of the pump room 16.

The connecting pipe 37 is a pipe bent such that a projection portion 37*a* thereof is positioned upwardly. By disposing the connecting pipe 37 such that the projection portion 37*a* thereof is positioned upwardly, even if water should enter the connecting pipe 37 from the tail pipe 38, advancement of water to the engine 15 side can be prevented since the entering water cannot go beyond the projection portion 37*a* of the connecting pipe 37. In other words, the connecting pipe 37 has a water locking function.

Figure 3:
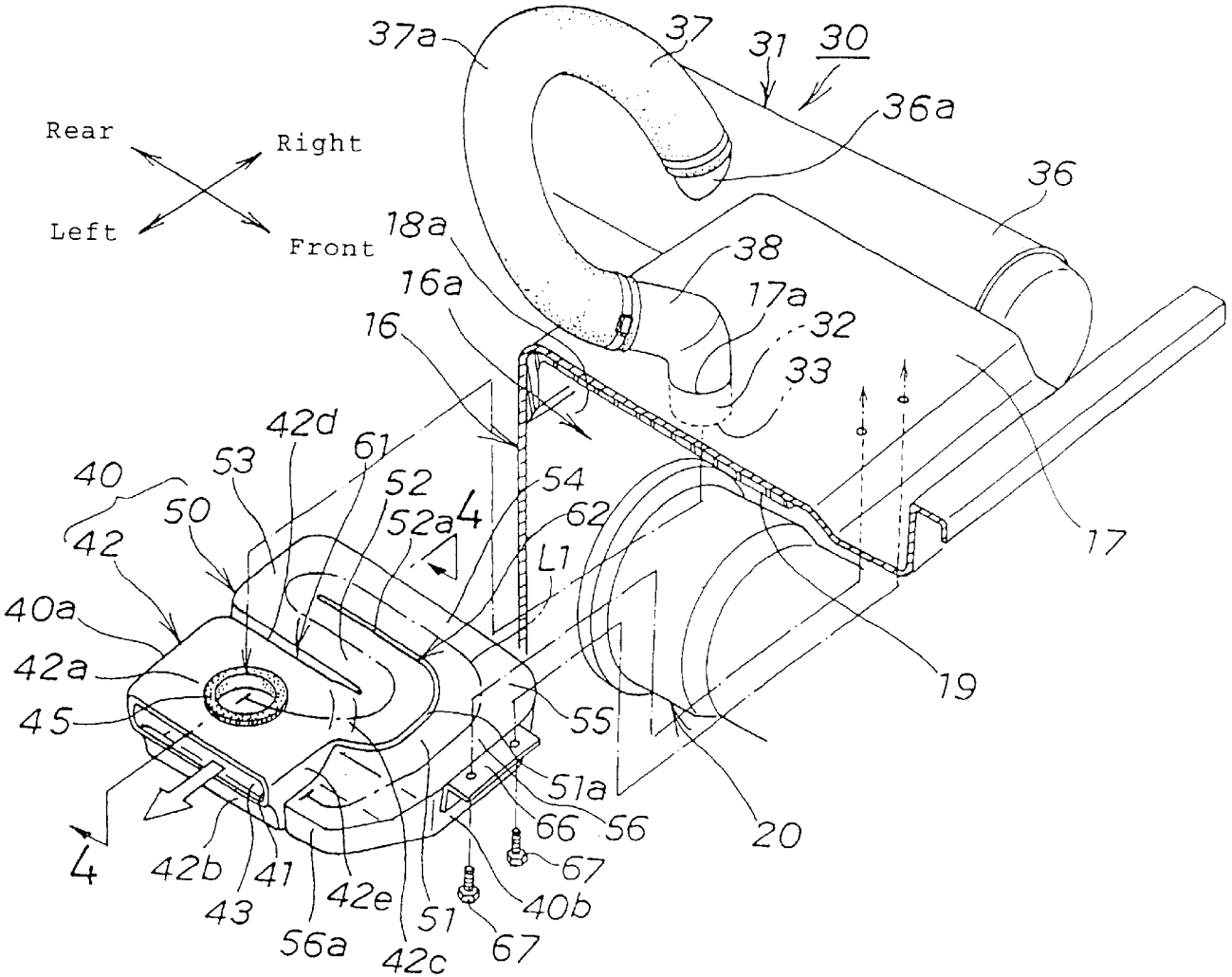
FIG. 3 is an exploded perspective view of the exhaust structure (first embodiment) for a jet propulsion watercraft according to the present invention.

FIG. 3 is an exploded perspective view of the exhaust structure (first embodiment) for a jet propulsion watercraft according to the present invention.

The resonator 40 is a member which is bent in a meandering state such that different bent portions thereof are positioned adjacent to each other so that the entire resonator 40 may have a profile substantially like a flat plate.

The resonator 40 includes a base portion 42 attached to the end portion 32 of the tail pipe 38, and a resonator body 50 formed integrally with the base portion 42.

The base portion 42 is a frame member of a substantially rectangular shape having a hollow portion 43 in the inside thereof and has an opening 44 (shown in FIG. 4) in an upper face 42*a* of the frame member. A packing 45 is attached to the opening 44. The inner diameter of the packing 45 is set a little greater than the outer diameter of the tail pipe 38 so that the end portion 32 of the tail pipe 38 can be inserted into the packing 45 until the exhaust opening 33 of the tail pipe 38 (that is, the exhaust opening of the exhaust gas pipe 31) is exposed to the hollow 43 of the base portion 42.

In addition, the base portion 42 has the rectangular exhaust opening 41 at an upper half of a left side 42*b* thereof. The exhaust opening 41 is exposed to the internal space 16*a* of the pump room 16 such that exhaust gas flowing into the hollow 43 of the base portion 42 from the end portion 32 of the tail pipe 38 can be exhausted into the internal space 16*a* of the pump room 16 through the exhaust opening 41 of the base portion 42.

The resonator body 50 is a hollow pipe of a rectangular cross section extending in a meandering state from a right rear corner 42*c* of the base portion 42, and the hollow pipe is in communication with the hollow 43 of the base portion 42.

The resonator body 50 is formed such that a first bent portion 51 is bent by approximately 180° in the counterclockwise direction from the right rear corner 42*c* of the base portion 42. A first extending portion 52 extends forwardly from an end of the first bent portion 51 along the right side 42*d* of the base portion 42. A second bent portion 53 is bent by approximately 180° in the clockwise direction from an end of the first extending portion 52. A second extending portion 54 extends rearwardly from an end of the second bent portion 53 along the right side 52*a* of the first extending portion 52. A third bent portion 55 is bent by approximately 90° in the clockwise direction from an end of the second extending portion 54. A third extending portion 56 extends from an end of the third bent portion 55 along the rear side 51 a of the first bent portion 51 and the rear side 42*e* of the base portion 42.

It is to be noted that an end 56*a* of the third extending portion 56, that is, an end of the resonator body 50, is formed in a closed up state.

By bending the resonator body 50 in a meandering state in this manner, the length L1 of the resonator 40 can be set to a desired length while the resonator 40 is suppressed to be compact. Since the resonator 40 can be formed with a desired length, the sound deadening effect for the exhaust noise can be raised sufficiently making use of the resonance of the exhaust noise.

Further, by bending the resonator 40 in a meandering state, a first gap 61 and a second gap 62 are formed. If a first rib 63 (shown in FIG. 4) and a second rib 64 (shown in FIG. 4) are provided in the first gap 61 and the second gap 62, respectively, then the portions on the opposite sides of the first gap 61 can be connected integrally and the portions on the opposite sides of the second gap 62 can be connected integrally.

Consequently, the entire resonator 40 can be formed in a substantially rectangular shape (in the form of a flat plate). Since the resonator 40 is configured in a plate-like profile, the resonator 40 can be formed compact and can be disposed in a comparatively small accommodation space.

Since the accommodation space in which the resonator 40 is accommodated can be made comparatively small, it can be readily assured. Further, since the resonator 40 can be formed compact, handling of the resonator 40 can be simplified. Therefore, an attaching operation of the resonator 40 can be simply performed without any skill.

Since the accommodation space in which the resonator 40 is disposed can be assured readily and besides the attaching operation of the resonator 40 can be simply performed in this manner, exhaust noise can be simply reduced.

Further, a mounting bracket 65 (shown in FIG. 2) is provided on a front wall 40*a* of the resonator 40 having a plate-like configuration, and a mounting bracket 66 is provided on a rear wall 40*b* of the resonator 40.

The resonator 40 can be attached to the ceiling wall 17 of the pump room 16 by attaching the mounting bracket 65 to a front wall 18*a* of the pump room 16 by means of bolts 67, 67 and attaching the mounting bracket 66 to the ceiling wall 17 of the pump room 16 (wall face of the watercraft body) by means of bolts 67, 67.

The tail pipe 38 can be attached to the ceiling wall 17 of the pump room 16 by attaching the resonator 40 to the ceiling wall 17 of the pump room 16. Therefore, since the connecting pipe 37 for establishing communication with the tail pipe 38 can be made short to the utmost, the space in the watercraft body 11 can be assured.

The resonator 40 that is made compact in a plate-like configuration in this manner can be further simply attached by laying the resonator 40 along the ceiling wall 17 of the pump room 16 (refer to FIG. 2).

The reason is that generally a surplus space does not remain inside of the watercraft body 11 because various watercraft accessories are attached. However, a space often remains in the proximity of a wall face of the watercraft body 11. Therefore, a dead space remaining in the proximity of a wall face is utilized to attach the resonator 40 so that the resonator 40 can be further simply attached.

Particularly, the pump room 16 is outside the watercraft body 11, and the resonator 40 can be attached to the outside of the watercraft body 11 by laying the resonator 40 along the ceiling wall 17 of the pump room 16. In addition, a space around the ceiling wall 17 of the pump room 16 remains as a dead space. Therefore, by laying the resonator 40 along the ceiling wall 17 of the pump room 16, the remaining dead space can be utilized to attach the resonator 40.

Further, since the resonator 40 is attached to the outside of the watercraft body 11, there is no need to assure the accommodation space for accommodating the resonator 40 inside of the watercraft body 11.

By laying the resonator 40 along the ceiling wall 17 of the pump room 16 in this manner, the resonator 40 can be further simply attached.

Further, since the resonator body 50 is bent in a meandering state, even if water should try to enter the resonator body 50 from the exhaust opening 41, the water cannot be admitted readily into the inside of the resonator body 50 when compared with another resonator which extends linearly.

Here, it is also possible to form a drainage hole in order that the entering water may be drained in case water enters the resonator 40. Even if a hole is formed in the resonator, if the hole is a comparatively small drainage hole, the sound deadening effect of the resonator 40 is not degraded.

If the position at which the drainage hole is formed is a position near to an end of the resonator body 50, for example, then water which cannot be drained comparatively readily can be drained efficiently.

Further, it is also possible to attach the resonator 40 in an inclined state such that the exhaust opening 41 may be positioned lower than the end of the resonator 40 by taking the drainage efficiency of the resonator 40 into consideration.

However, even if the resonator 40 is attached horizontally without being provided with the drainage hole, water can still be discharged together with exhaust gas from the exhaust opening 41 of the resonator.

Figure 4:
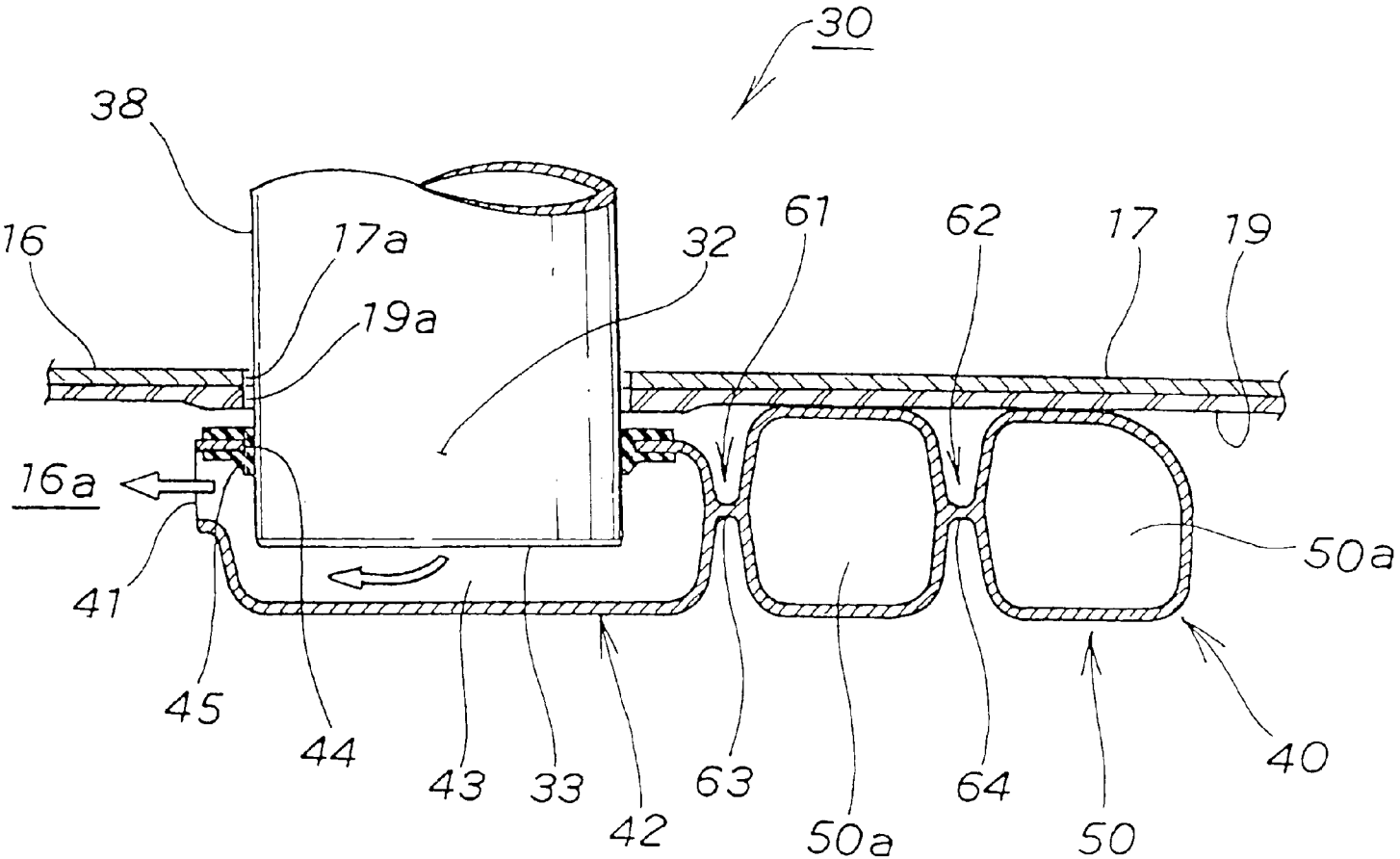
FIG. 4 is a sectional view taken along line 4—4 of FIG. 3.

FIG. 4 is a sectional view taken along line 4—4 of FIG. 3 and shows a state wherein a heat insulating plate 19 is attached to the rear face of the ceiling wall 17 of the pump room 16 with the resonator 40 is provided on the rear face side of the heat insulating plate 19. The end portion 32 of the tail pipe 38 is inserted in an opening 17*a* of the ceiling wall 17 of the pump room 16 and an opening 19*a* of the heat insulating plate 19 and is fitted in the packing 45 such that the exhaust opening 33 of the tail pipe 38 is exposed to the hollow 43 of the base portion 42. In addition, the exhaust opening 41 of the base portion 41 is exposed to the internal space 16*a* of the pump room 16.

Further, FIG. 4 shows a state wherein the first rib 63 and the second rib 64 are provided in the first gap 61 and the second gap 62 of the resonator body 50, respectively, such that the portions on the opposite sides of the first gap 61 are connected integrally and the portions on the opposite sides of the second gap 62 are connected integrally.

Since the first and second ribs 63 and 64 are provided in the first and second gaps 61 and 62, the resonator 40 can be formed in a plate-like profile and compact formation of the resonator 40 can be anticipated.

Consequently, exhaust gas flows out from the exhaust opening 33 of the tail pipe 38 into the hollow 43 of the base portion 42, and the exhaust gas having flown into the hollow 43 of the base portion 42 can be exhausted into the internal space 16*a* of the pump room 16 through the exhaust opening 41 of the base portion 42.

Further, since a hollow 50*a* of the resonator body 50 is in communication with the hollow 43 of the base portion 42, the resonator body 50 can be in communication with the connecting pipe 37 through the tail pipe 38. Consequently, exhaust noise can be reduced making use of the resonance of exhaust noise.

Now, second to fifth embodiments are described with reference to FIGS. 5 to 11. It is to be noted that like elements to those of the first embodiment are denoted by like reference characters and a description thereof is omitted.

Figure 5:
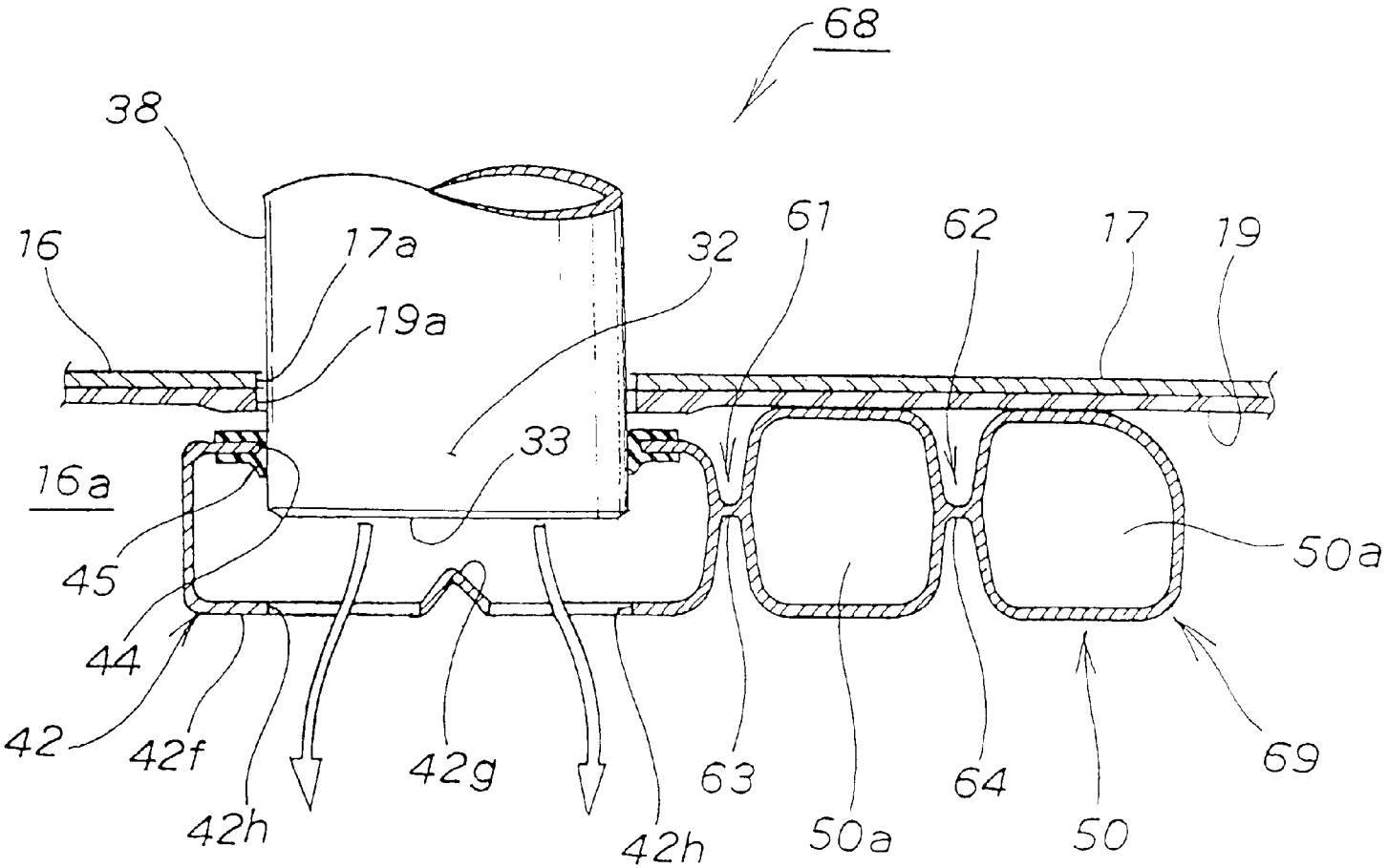
FIG. 5 is a sectional view of the exhaust structure (second embodiment) for a jet propulsion watercraft according to the present invention.

FIG. 5 is a sectional view of another exhaust structure (second embodiment) for a jet propulsion watercraft according to the present invention.

The exhaust structure 68 replaces the resonator 40 in the first embodiment by a resonator 69, and the other configuration thereof is similar to that of the first embodiment.

In the resonator 69, a mountain-shaped projection 42*g* is provided at the center of a bottom face 42*f* of the base portion 42, that is, a face of the base portion 42 opposing to the exhaust opening 33 of the tail pipe 38, and a pair of openings 42*h*, 42*h* are provided on the opposite sides of the projection 42*g* Therefore, exhaust gas can be exhausted efficiently as indicated by arrow marks from the exhaust opening 33 of the tail pipe 38 through the openings 42*h*, 42*h*.

In addition, since the projection 42*g* has a mountain-like shape, it can introduce exhaust gas to the openings 42*h*, 42*h* efficiently with the mountain shape thereof.

While the projection 42*g* described is formed as a rib which extends linearly in a direction perpendicular to the plane of FIG. 5, the projection 42*g* is not limited to this, and it is possible to form the projection 42*g* in a conical shape and form openings around the projection 42*g*.

With the second embodiment, similar effects to those of the first embodiment can be achieved. Further, with the second embodiment, since the openings 42*h*, 42*h* are provided at the position opposing to the exhaust opening 33 of the tail pipe 38, exhaust gas can be exhausted efficiently as indicated by the arrow marks from the exhaust opening 33 of the tail pipe 38 through the openings 42*h*, 42*h*.

Here, the connecting pipe 37 which serves as an exhaust pipe in the first and second embodiments is described.

Figure 6:
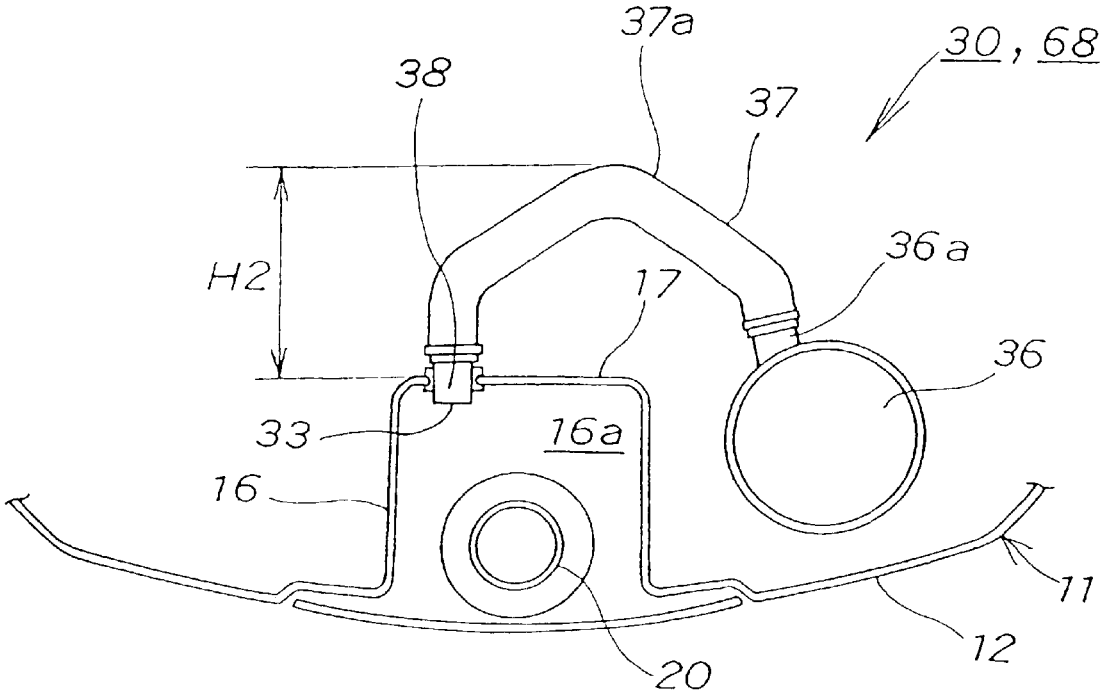
FIG. 6 is a rear elevational view of a connecting pipe for the exhaust structure (first and second embodiments) for a jet propulsion watercraft according to the present invention.

FIG. 6 is a rear elevational view of the connecting pipe which composes the exhaust structure (in the first and second embodiments) for a jet propulsion watercraft according to the present invention.

In the exhaust structures 30 and 68 for a jet propulsion watercraft of the first and second embodiments, the entrance side of the connecting pipe 37 is attached to the exit 36*a* of the muffler 36 while the exit side of the connecting pipe 37 is attached to the tail pipe 38 and the tail pipe 38 is attached to the ceiling wall 17 of the pump room 16 such that the exhaust opening 33 of the tail pipe 38 is exposed to the internal space 16*a* of the pump room 16.

By attaching the connecting pipe 37 to the ceiling wall 17 of the pump room 16, the connecting pipe 37 can be formed short.

The connecting pipe 37 is a pipe bent such that the projection portion 37*a* thereof is positioned higher by H2 than the ceiling wall 17. By disposing the projection portion 37*a* of the connecting pipe 37 upwardly, even if water should enter the connecting pipe 37 from the tail pipe 38, admission of the water to the engine 15 side shown in FIG. 1 can be prevented, since the entering water cannot go beyond the projection portion 37*a* of the connecting pipe 37. In other words, the connecting pipe 37 has a water locking function.

Here, since, generally in a conventional jet propulsion watercraft, a connecting pipe of an exhaust pipe is attached to a side wall of a pump room (a side wall on the opposite side to a muffler), the connecting pipe is comparatively long. For example, when the length of the connecting pipe is 1 m, in the case of a 4-cylinder engine (4 cycle), resonance sound is generated at a comparatively low rotational speed (approximately 2,800 rpm). In this region of the engine speed, environmental noise is in a comparatively low state, and if resonance sound is generated in this state, it sounds offensive to the ear.

In contrast, since, in the first and second embodiments, the connecting pipe 37 of the exhaust pipe is attached to the ceiling wall 17 of the pump room 16, the connecting pipe 37 can be made short. For example, in case the length of the connecting pipe 37 is 60 cm, in the case of a 4-cylinder engine (4 cycle), resonance sound is generated at a comparatively high rotational speed (approximately 4,700-rpm). In this region of the engine speed, environmental noise is in a comparatively high state, and even if resonance sound is generated in this state, it does not sound offensive to the ear.

In this manner, by making the connecting pipe 37 short, resonance sound can be prevented from sounding offensive to the ear, and an effect similar to that achieved by a reduction of the exhaust sound can be anticipated.

Accordingly, with the first and second embodiments, by making the connecting pipe 37 short, the exhaust sound can be prevented from sounding offensive to the ear. In addition, since the reduction of exhaust sound can be achieved through the provision of the resonator 40 or 69, exhaust noise can be reduced efficiently.

Further, with the first and second embodiments, the ceiling wall 17 to which the tail pipe 38 is attached is a horizontal plane spaced away from the watercraft bottom 12, and a comparatively great space can be assured around the ceiling wall 17. Therefore, an operation of attaching the tail pipe 38 to the ceiling wall 17 can be performed readily and simply.

Figure 7:
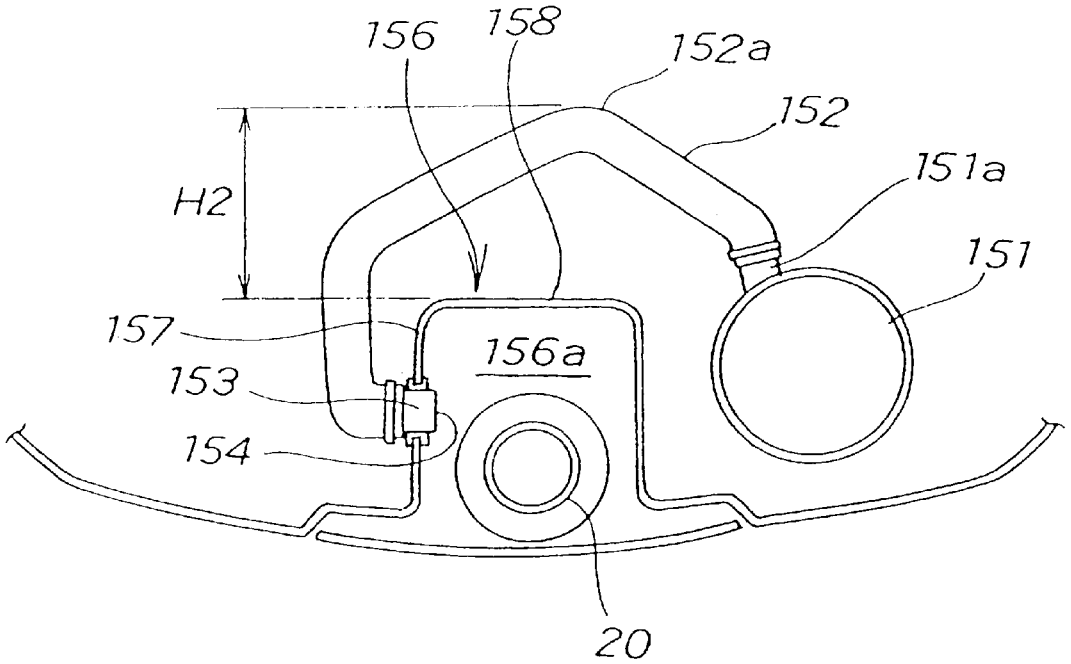
FIG. 7 is a rear elevational view of a connecting pipe for an exhaust structure (comparative example) for a jet propulsion watercraft.

FIG. 7 is a rear elevational view of a connecting pipe forming an exhaust structure for a jet propulsion watercraft (comparative example).

The exhaust structure for a jet propulsion watercraft of the comparative example is configured such that an exit 151*a* of a muffler 151 is attached to the entrance side of a connecting pipe 152 while the exit side of the connecting pipe 152 is attached to a tail pipe 153 and the tail pipe 153 is attached to a left side wall 157 of a pump room 156 (that is, a side wall on the opposite side to the muffler 151) such that an exhaust opening 154 of the tail pipe 153 is exposed to an internal space 156*a* of the pump room 156.

Since the connecting pipe 152 is attached to the left side wall 157 of the pump room 156 through the tail pipe 153, the connecting pipe 152 becomes long.

It is to be noted that the connecting pipe 152 is a pipe bent such that a projection portion 152*a* thereof is positioned higher by H2 than a ceiling wall 158, and has a water locking function similarly to the connecting pipe 37 shown in FIG. 6.

With the exhaust structure for a jet propulsion watercraft of the comparative example, since the connecting pipe 152 is attached to the left side wall 157 of the pump room 156, the length of the connecting pipe 152 becomes long, for example, as long as 1 m. Consequently, as described above, in the case of a 4-cylinder engine (4 cycle), resonance sound is generated at a comparatively low rotational speed (approximately 2,800 rpm) and is likely to sound offensive to the ear.

In addition, the left side wall 157 to which the tail pipe 153 is attached is a vertical plane comparatively near to the watercraft bottom 12, and it is difficult to assure a comparatively great space around the left side wall 157. Therefore, a comparatively long time is required for an operation for attaching the tail pipe 153 to the left side wall 157.

Subsequently, the third embodiment is described.

Figure 8:
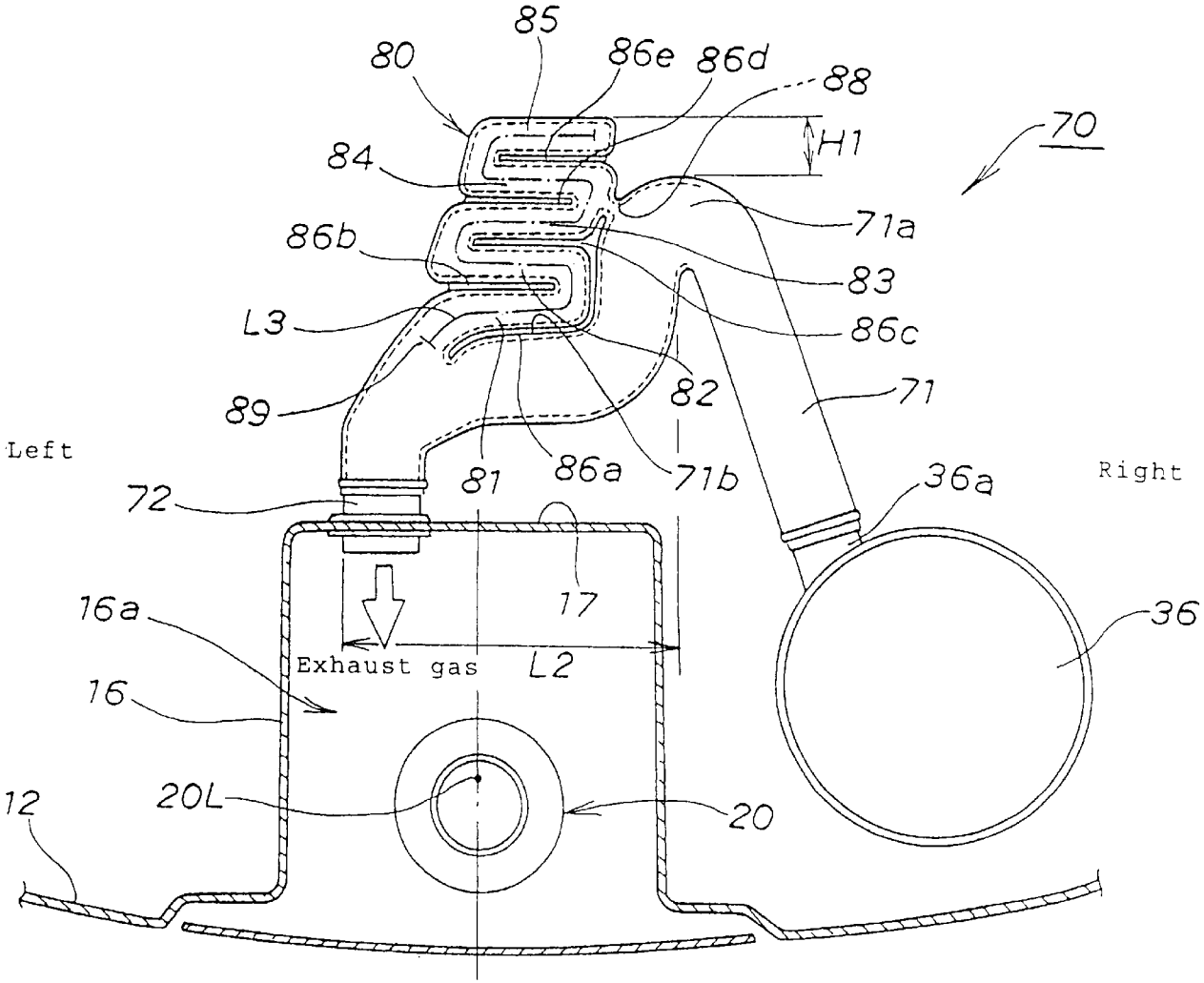
FIG. 8 is a schematic view of essential part of a further exhaust structure (third embodiment) for a jet propulsion watercraft according to the present invention.

FIG. 8 is a schematic view of essential part of a further exhaust structure (third embodiment) for a jet propulsion watercraft according to the present invention.

The exhaust structure 70 for a jet propulsion watercraft is configured such that the entrance side of a connecting pipe 71 is attached to an exit 36*a* of a muffler 36 while the exit side of the connecting pipe 71 is attached to a tail pipe 72, and the tail pipe 72 is attached to a ceiling wall 17 of a pump room 16 such that an exhaust opening 73 of the tail pipe 72 (an exhaust opening of an exhaust pipe) is exposed to an internal space 16*a* of the pump room 16 and a resonator 80 is formed integrally with the connecting pipe 71.

The ceiling wall 17 to which the tail pipe 72 is attached is a horizontal plane spaced away from the watercraft bottom 12, and a comparatively great space can be assured around the ceiling wall 17. Therefore, an operation of attaching the tail pipe 72 to the ceiling wall 17 can be comparatively simply performed.

It is to be noted that the mounted position of the tail pipe 72 is particularly on the left side with respect to a center line 20L of the water jet pump 20, that is, the side spaced away from the muffler 36. The reason why the mounted position of the tail pipe 72 is spaced away from the muffler 36 is hereinafter described.

The exhaust structure 70 for a jet propulsion watercraft of the third embodiment is different from that of the first embodiment in that the resonator 80 is provided for the connecting pipe 71, but is common with respect to the other configurations of the first embodiment. Therefore, in the third embodiment, a description is given of the connecting pipe 71 and the resonator 80, and description of the other elements is omitted.

The connecting pipe 71 is a pipe bent such that a projection portion 71*a* thereof is positioned upwardly. By disposing the connecting pipe 71 such that the projection portion 71*a* thereof is positioned upwardly, even if water enters the connecting pipe 71 from the exhaust opening 73 of the tail pipe 72, the entering water cannot go beyond the projection portion 71*a* of the connecting pipe 71. Consequently, the water can be prevented from entering the engine 15 side as shown in FIG. 2. In other words, the connecting pipe 71 has a water locking function.

Further, the connecting pipe 71 is configured such that a recess portion 71*b* is formed on the left side of the projection portion 71*a* and the resonator 80 is accommodated in the recess portion 71*b*. Since the connecting pipe 71 is disposed such that the resonator 80 is accommodated in the resonator 80, the projecting height H1 of the resonator 80 can be suppressed.

Here, since the mounted position of the tail pipe 72 is on the left side with respect to the center line 20L of the water jet pump 20, that is, the side spaced away from the muffler 36 as described hereinabove, the horizontal portion of the connecting pipe 71 can be formed as long as L2 by attaching the tail pipe 72 to the ceiling wall 17 on the side spaced away from the muffler 36.

Therefore, since the recess portion 71*b* for accommodating the resonator 80 can be greatly improved, the resonator 80 can be set longer.

The resonator 80 is a member bent in a meandering state such that the bent different portions thereof are positioned adjacent to each other so that the entire resonator 80 may have a profile substantially like a flat plate.

In particular, the resonator 80 is configured such that a first extending portion 81 extends along the recess portion 71*b* of the connecting pipe 71; a second extending portion 82 is bent by approximately 180° in the counterclockwise direction at an end portion of the first extending portion 81 and extends along the first extending portion 81; a third extending portion 83 is bent by approximately 180° in the clockwise direction at an end portion of the second extending portion 82 and extends along the second extending portion 82; a fourth extending portion 84 is bent by approximately 180° in the counterclockwise direction at an end portion of the third extending portion 83 and extends along the third extending portion 83; and a fifth extending portion 85 is bent by approximately 180° in the clockwise direction at an end portion of the fourth extending portion 84 and extends along the fourth extending portion 84. An end of the fifth extending portion 85 is closed.

The resonator 80 is configured such that the connecting pipe 71 and the first extending portion 81 are connected to each other by a first rib 86*a* with a gap therebetween. The first extending portion 81 and the second extending portion 82 are connected to each other by a second rib 86*b* with a gap therebetween. The second extending portion 82 and the third extending portion 83 are connected to each other by a third rib 86*c* with a gap therebetween. The third extending portion 83 and the fourth extending portion 84 are connected to each other by a fourth rib 86*d* with a gap therebetween. Similarly, the fourth extending portion 84 and the fifth extending portion 85 are connected to each other by a fifth rib 86*e* with a gap therebetween.

Consequently, the entire resonator 80 can be formed in a shape of a substantially flat plate.

With the resonator 80 in the third embodiment, the length L3 of the resonator 80 can be set to a desired length while forming the resonator 80 to be compact by bending the resonator 80 in a meandering state.

Further, by attaching the tail pipe 72 to the ceiling wall 17 on the side spaced away from the muffler 36, the horizontal portion of the connecting pipe 71 is formed as long as L2. The recess portion 71*b* for accommodating the exhaust structure 70 can be greatly improved. Therefore, the length of the resonator 80 can be set longer.

Accordingly, since the resonator 80 can be formed with a desired length, the resonance of the exhaust noise can be utilized to sufficiently raise the sound deadening effect for exhaust noise.

Further, the entire resonator 80 can be formed in a substantially rectangular shape (in the form of a flat plate). By forming the resonator 80 like a plate, the resonator 80 can be formed compact and can be disposed in a comparatively small accommodation space.

Since the accommodation space for disposing the resonator 80 can be made comparatively small, the accommodation space can be simply assured. Further, since compact formation of the resonator 80 can be achieved, handling of the resonator 80 can be simplified. Therefore, an attaching operation for the resonator 80 can be simply performed without requiring much skill.

Since the accommodation space for disposing the resonator 80 can be assured simply and an attaching operation for the resonator 80 can be simply performed in this manner, exhaust noise can be simply reduced.

Further, with the third embodiment, since the resonator 80 having a plate-like configuration is provided in the recess portion 71*b* of the connecting pipe 71, it can be attached along a rear wall 11*b* of the watercraft body 11 shown in FIG. 1 (a wall face of the watercraft).

By attaching the resonator 80 formed compact in a plate-like configuration along the rear wall 11*b* of the watercraft body 11 in this manner, the resonator 80 can be further simply attached.

The reason that, generally, a surplus space does not remain inside of the watercraft body is because various watercraft accessories are attached in this space. However, a space often remains in the proximity of the rear wall 11*b* of the watercraft body 11. Therefore, an accommodation space remaining in the proximity of the rear wall 11*b* is made the most of to attach the resonator 80 so that the resonator 80 can be further simply attached.

In addition, since the resonator 80 is bent in a meandering state, even if water should try to enter the resonator 80 from the exhaust opening 41, the water cannot be admitted readily into the inside of the resonator 80 when compared with another resonator which extends linearly.

Incidentally, in the resonator 80, the bent portion which connects the third extending portion 83 and the fourth extending portion 84 to each other is in communication with the projection portion 71*a* of the connecting pipe 71 by a drain pipe 88. By communicating the resonator 80 with the connecting pipe 71 by the drain pipe 88, water entering the resonator 80 can be drained efficiently to the connecting pipe 71 side through the drain pipe 88.

However, even if the drain pipe 88 is not provided for the resonator 80, water entering the resonator 80 can be drained readily from an opening 89 of the resonator 80.

Subsequently, the fourth embodiment is described.

Figure 9A:
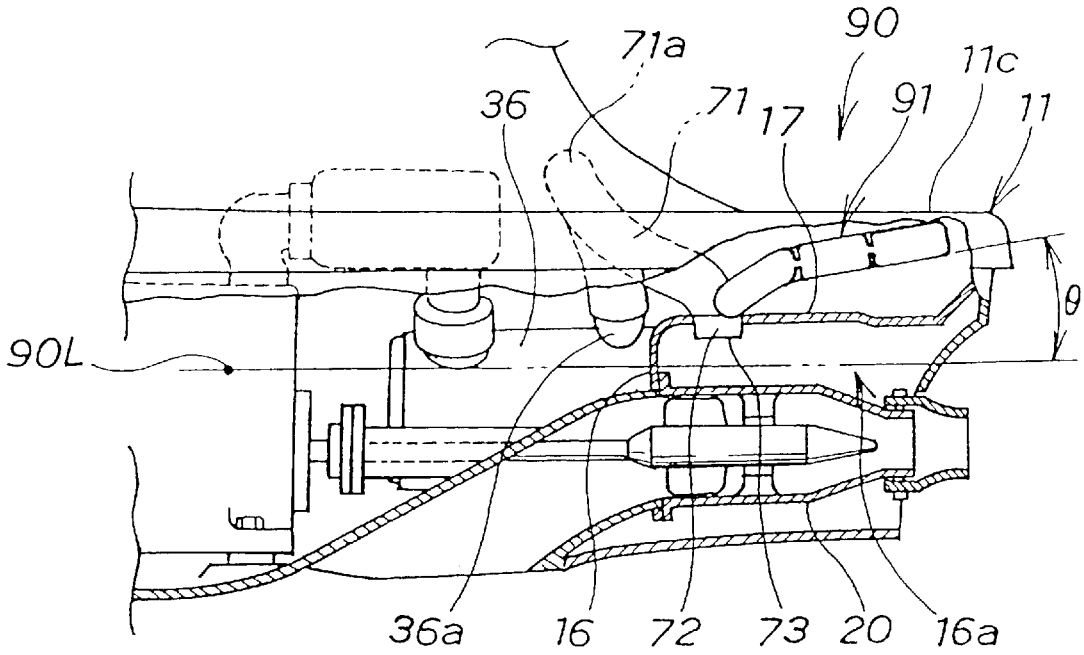
FIGS. 9(*a*) and 9(*b*0 are schematic views of essential part of a still further exhaust structure (fourth embodiment) for a jet propulsion watercraft according to the present invention.
Figure 9B:
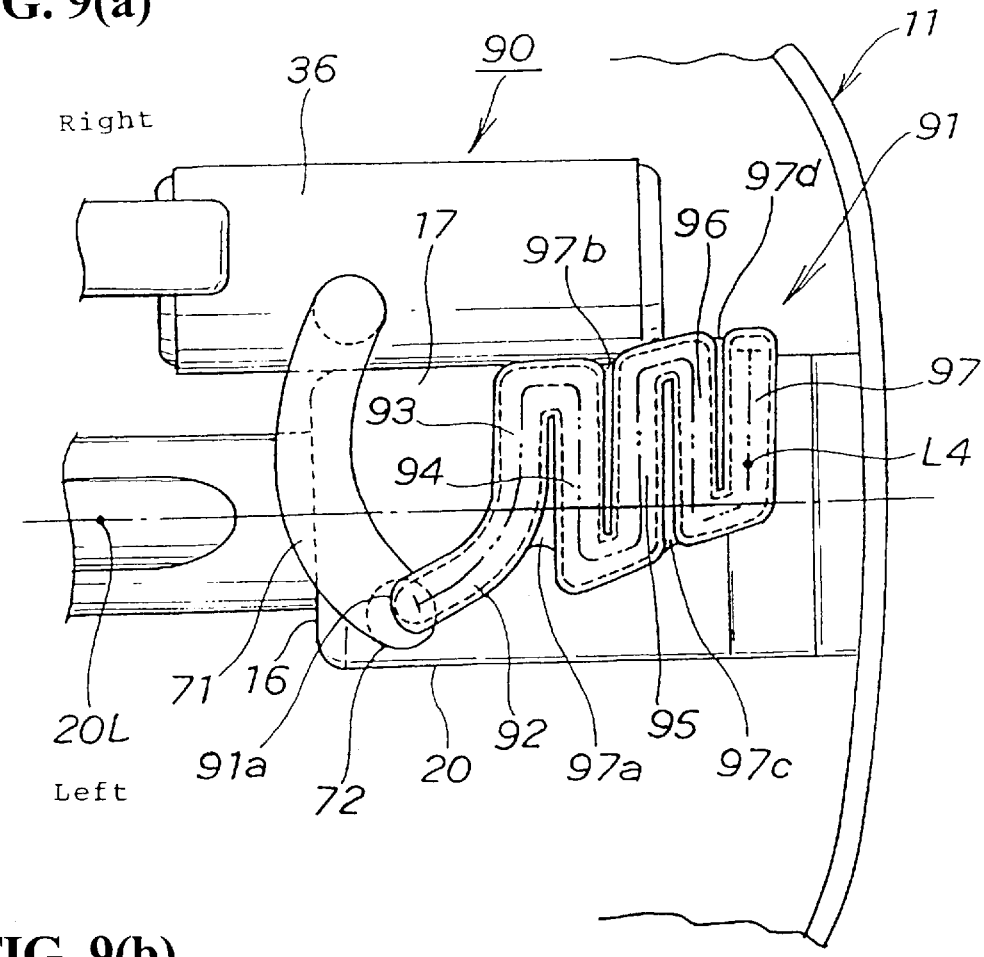

FIGS. 9(*a*) and 9(*b*) are schematic views of essential part of the exhaust structure (fourth embodiment) for a jet propulsion watercraft according to the present invention, and FIG. 9(*a*) shows a side elevational view and FIG. 9(*b*) shows a plan view in a state wherein a rear deck is removed.

The exhaust structure 90 for a jet propulsion watercraft is configured such that the entrance side of the connecting pipe 71 is attached to an exit 36*a* of a muffler 36 while a tail pipe 72 is attached to the exit side of the connecting pipe 71 and the tail pipe 72 is attached to a ceiling wall 17 of a pump room 16 such that an exhaust opening 73 of the tail pipe 72 (an exhaust opening of an exhaust pipe) is exposed to an internal space 16*a* of the pump room 16 and a resonator 91 is formed integrally with the connecting pipe 71.

The exhaust structure 90 for a jet propulsion watercraft of the fourth embodiment is different from that in the third embodiment only in that the resonator 91 is inclined rearwardly upwards with an angle θ and extends along a rear deck 11*c* of the watercraft body 11. This structure is the same as the configuration of the third embodiment. Therefore, in the fourth embodiment, description of the resonator 91 is given and a description of the other elements is omitted. It is to be noted that reference character 90L denotes a water surface.

Here, the mounted position of the tail pipe 72 is the left side with respect to a center line 20L (shown in FIG. 9(*b*)) of the water jet pump 20, that is, the side spaced away from the muffler 36 as described in connection with the third embodiment. In addition, since an entrance portion 91 a of the resonator 91 is formed in the proximity of the tail pipe 72, the entrance portion 91*a* can be disposed on the left side of the ceiling wall 17.

Consequently, the resonator 91 can be disposed above the ceiling wall 17. The watercraft body 11 has a comparatively great dead space above the ceiling wall 17, that is, along the rear deck 11*c* of the watercraft body 11 (a wall face of the watercraft body). Consequently, the resonator 91 can be formed longer when disposed in the dead space.

The resonator 91 is a member bent in a meandering state such that the bent portions thereof are positioned adjacent to each other so that the entire resonator 80 may have a profile substantially like a flat plate similarly to the resonator 80 in the third embodiment.

In particular, the resonator 91 is configured such that a first extending portion 92 extends obliquely rearwardly from the connecting pipe 71; a second extending portion 93 is bent in a transverse direction (toward the muffler) at an end portion of the first extending portion 92; a third extending portion 94 is bent by approximately 180° in the clockwise direction at an end portion of the second extending portion 93 and extends along the second extending portion 93; a fourth extending portion 95 is bent by approximately 180° in the counterclockwise direction at an end portion of the third extending portion 94 and extends along the third extending portion 94; a fifth extending portion 96 is bent by approximately 180° in the clockwise direction at an end portion of the fourth extending portion 95 and extends along the fourth extending portion 95; and a sixth extending portion 97 is bent by approximately 180° in the counterclockwise direction at an end portion of the fifth extending portion 96 and extends along the fifth extending portion 96. An end of the sixth extending portion 97 is closed.

The resonator 91 is configured such that the second extending portion 93 and the third extending portion 94 are connected to each other by a first rib 97*a* with a gap therebetween. The third extending portion 94 and the fourth extending portion 95 are connected to each other by a second rib 97*b* with a gap therebetween. The fourth extending portion 95 and the fifth extending portion 96 are connected to each other by a third rib 97*c* with a gap therebetween. Similarly, the fifth extending portion 96 and the sixth extending portion 97 are connected to each other by a fourth rib 97*d* with a gap therebetween.

Consequently, the resonator 91 can be generally formed in a shape of a substantially flat plate.

With the fourth embodiment, the length L4 of the resonator 91 can be set to a desired length while forming the resonator 91 to be compact by bending the resonator 91 in a meandering state.

Further, with the fourth embodiment, the mounted position of the tail pipe 72 is on the left side with respect to the center line 20L and the entrance portion 91*a* of the resonator 91 is formed in the proximity of the tail pipe 72. Consequently, since the entrance portion 91*a* can be disposed on the left side of the ceiling wall 17, the resonator 91 can be disposed above the ceiling wall 17.

Since a comparatively large dead space is provided above the ceiling wall 17, the resonator 91 can be formed long. Therefore, since the resonator 91 can be formed with a desired length, the sound deadening effect of the exhaust noise can be raised sufficiently making use of the resonance of the exhaust sound.

Further, the entire resonator 91 can be formed in a substantially rectangular shape (in the form of a flat plate). Since the resonator 91 is configured in a plate-like profile, the resonator 91 can be formed to be compact and can be disposed in a comparatively small accommodation space.

Since the accommodation space for disposing the resonator 91 can be made comparatively small, the accommodation space can be assured comparatively simply. Further, since compact formation of the resonator 91 can be achieved, the handling of the resonator 91 can be simplified. Therefore, an attaching operation for the resonator 91 can be simply performed without requiring much skill.

Since the accommodation space for disposing of the resonator 91 can be assured simply and an attaching operation for the resonator 91 can be simply performed in this manner, exhaust noise can be simply reduced.

Further, the resonator 91 can be attached along the rear deck 11*c* of the watercraft body 11 (a wall face of the watercraft body). By attaching the resonator 91 to be formed compact in a plate-like configuration along the rear deck 11*c* of the watercraft body 11 in this manner, the resonator 91 can be further simply attached.

The reason that a surplus space does not remain inside of a watercraft body, in general, is because various watercraft accessories are attached within this space. However, a space often remains in the proximity of the rear deck 11*c* of the watercraft body 11. Therefore, a dead space remaining in the proximity of the rear deck 11*c* is utilized to attach the resonator 91 so that the resonator 91 can be further simply attached.

In addition, since the resonator 91 is bent in a meandering state, even if water should try to enter the resonator 91 from the exhaust opening 41, the water is less likely to be admitted inside of the resonator 91 when compared with an ordinary resonator which extends linearly.

Further, the resonator 91 is inclined rearwardly upwards with the angle θ with respect to a water surface 90L. Consequently, water entering the resonator 91 can be drained efficiently.

It is to be noted that it is also possible to form a drainage hole (not shown) in the middle of the resonator 91 so that the entering water may be drained efficiently even if water enters the resonator 91.

Now, the fifth embodiment is described.

Figure 10:
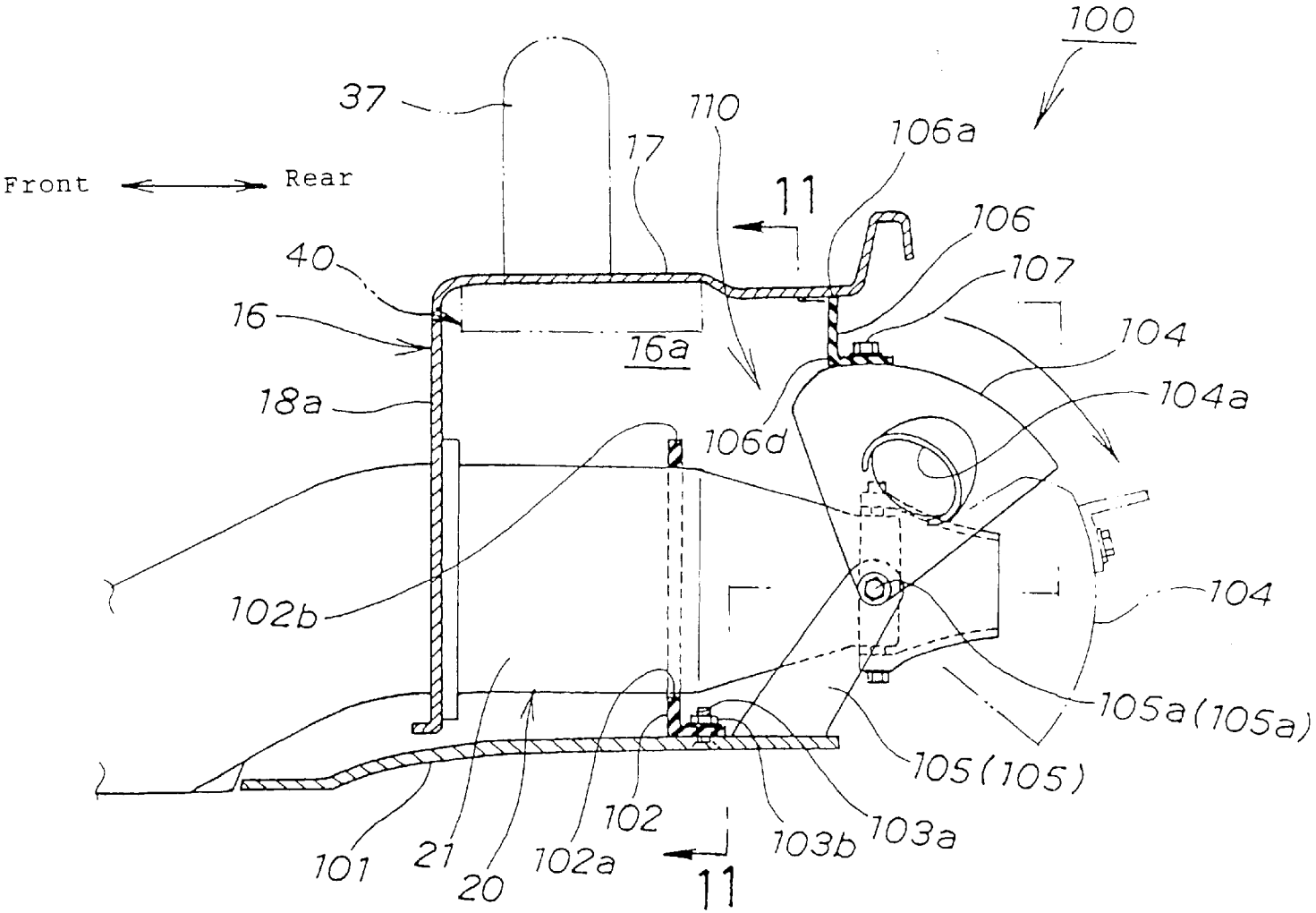
FIG. 10 is a schematic view of essential part of a yet further exhaust structure (fifth embodiment) for a jet propulsion watercraft according to the present invention.

FIG. 10 is a schematic view of an essential part of the exhaust structure (fifth embodiment) for a jet propulsion watercraft according to the present invention.

The exhaust structure 100 for a jet propulsion watercraft of the fifth embodiment includes a resonator 40 which is the same as that in the first embodiment on a ceiling wall 17 of a pump room 16 and includes a sound insulating plate as another countermeasure against exhaust sound.

In particular, the exhaust structure 100 for a jet propulsion watercraft is configured such that an internal space 16*a* is defined by a front wall 18*a* and left and right side walls 18*b* and 18*c* (shown in FIG. 11) which form a pump room 16. A ceiling wall 17 and a watercraft bottom plate 101 are provided while a lower side sound insulating plate 102 is secured to the watercraft bottom plate 101 by means of bolts 103*a*, . . . and nuts 103*b*, . . . A socket 102*a* of the lower side sound insulating plate 102 is fitted in a housing 21 of a water jet pump 20 while an upper side sound insulating plate 106 is secured to an upper end of a reverse basket 104 by means of bolts 107.

It is to be noted that the lower side sound insulating plate 102 is fastened to the housing 21 by means of bolts in a state wherein it is fitted in the housing 21 of the water jet pump 20.

The upper and lower side sound insulating plates 102 and 106 are formed from, for example, a rubber material. However, a different material such as a resin plate may be used alternatively.

It is to be noted that the reverse basket 104 is supported at left and right end portions thereof on left and right brackets 105, 105 for swinging movement between a standby position (position indicated by a solid line) and a retracted position (position indicated by an imaginary line) by means of left and right support shafts 105, 105*a*.

When the jet propulsion watercraft advances, the reverse basket 104 can be kept fixed at the upward standby position so that an upper end portion 106*a* of the upper side sound insulating plate 106 can contact with the ceiling wall 17 of the pump room 16.

Therefore, the internal space 16*a* of the pump room 16 can be closed to some degree with the upper and lower side sound insulating plates 102 and 106. Exhaust gas is exhausted from the connecting pipe 37 into the pump room 16. Accordingly, exhaust noise can be reduced by closing up the internal space 16*a* of the pump room 16 to some degree with the upper and lower side sound insulating plates 102 and 106.

Incidentally, when the jet propulsion watercraft is moved in a reverse direction, the reverse basket 104 is moved down as indicated by an arrow mark and is fixed at the retracted position indicated by an imaginary line. At this time, the upper side sound insulating plate 106 is spaced away from the ceiling wall 17 of the pump room 16 and does not play a role in closing up the internal space 16*a* of the pump room 16.

However, since the frequency by which the jet propulsion watercraft is moved in a rearward direction is lower than the frequency by which it is moved in a forward direction, the jet propulsion watercraft can be kept in a sound deadening state for almost the entire period of time.

The pump room 16 is outside the watercraft body 11, and the space of the pump room 16 remains as a dead space. By making the most of the dead space, the upper and lower side sound insulating plates 102 and 106 can be simply attached.

Figure 11:
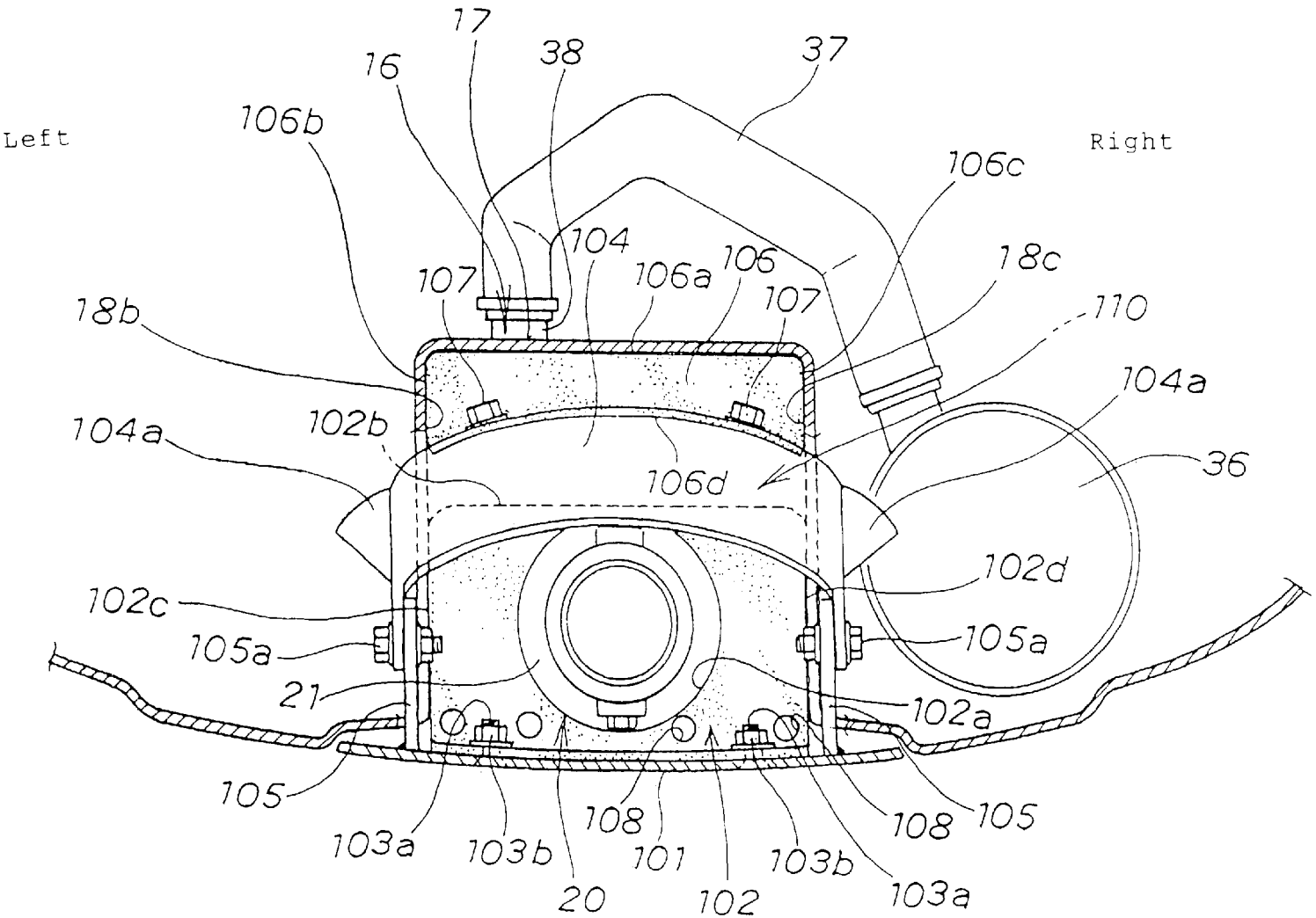
FIG. 11 is a sectional view taken along line 11—11 of FIG. 10.

FIG. 11 is a sectional view taken along line 11—11 of FIG. 10 showing a state wherein left and right end portions 102*c* and 102*d* of the lower side sound insulating plate 102 contact with the left and right side walls 18*b* and 18*c* of the pump room 16, respectively. The socket 102*a* of the lower side sound insulating plate 102 is fitted in the housing 21 of the water jet pump 20 while the upper end portion 106*a* of the upper side sound insulating plate 106 contacts with the ceiling wall 17 of the pump room 16 and left and right end portions 106*b* and 106*c* of the upper side sound insulating plate 106 contact with the left and right side walls 18*b* and 18*c* of the pump room 16, respectively.

Openings 104*a*, 104*a* for retro-firing are open in the reverse basket 104. A gap 110 (refer also to FIG. 9) is provided between an upper end portion 102*b* of the lower side sound insulating plate 102 and a lower end portion 106*d* of the upper side sound insulating plate 106. Therefore, exhaust gas flowing out into the internal space 16*a* of the pump room 16 through the muffler 36, connecting pipe 37 and tail pipe 38 can be exhausted to the outside efficiently through the gap 110 and the openings 104*a*, 104*a* for retro-firing.

Further, by forming drainage holes 108, . . . in the lower side sound insulating plate 102, water in the internal space 16*a* (shown in FIG. 10) of the pump room 16 can be drained through the drainage holes 108, . . .

It is to be noted that, since an opening for discharging exhaust gas therethrough can be simply obtained by making use of the openings 104*a*, 104*a* for retro-firing of the reverse basket 104 as a discharging path for exhaust gas, the configuration of the sound insulating plate can be further simplified.

Accordingly, with the fifth embodiment, since the resonator 40 in the first embodiment is provided and the internal space 16*a* of the pump room 16 is closed up, exhaust sound can be further reduced efficiently.

It is to be noted that, while, in the first to fifth embodiments, an example wherein an end portion of the connecting pipe 37 or 71 is attached to the ceiling wall 17 of the pump room 16 through the connecting pipe 37 or 72 is described, similar effects can also be achieved by attaching the end portion of the connecting pipe 37 or 71 in each of the first to fifth embodiments to a side wall of the pump room 16 (a side wall on the opposite side to the muffler).

In this instance, since the connecting pipe 37 or 71 becomes longer, it is necessary to set the resonator 40 or 80 comparatively long in conformity with the connecting pipe 37 or 71. However, since the resonator 40, 69, 80 or 91 is bent in a meandering state as described hereinabove in connection with the first to fifth embodiments, the resonator 40, 69, 80 or 91 can be formed with a sufficient length while it is formed compact.

In the fifth embodiment, an example is described wherein the lower side sound insulating plate 102 is provided on the watercraft bottom plate 101, and the housing 21 of the water jet pump 20 and the upper side sound insulating plate 106 is further provided on the reverse basket 104. However, the present invention is not only limited to this configuration. It is also possible to use other configurations which include either the lower side sound insulating plate 102 or the upper side sound insulating plate 106.

Furthermore, in the fifth embodiment, an example is described which includes the resonator 40 and which further includes the lower side sound insulating plate 102 and the upper side sound insulating plate 106. However, the present invention is not only limited to this configuration. It is also possible to use other configurations which include only the lower side sound insulating plate 102 and the upper side sound insulating plate 106.

The present invention exhibits the following effects through the configuration described above.

According to the present invention, the resonator is bent in a meandering state such that bent portions thereof are positioned adjacent to each other so that the entire resonator has a substantially flat plate-like configuration. Since compact formation of the resonator can be achieved through the formation of the entire resonator in a flat plate-like configuration, the resonator can be disposed in a comparatively small accommodation space.

Since the accommodation space in which the resonator is accommodated can be made comparatively small in this manner, the accommodation space can be assured comparatively readily.

Further, since the resonator can be formed compact, the handling of the resonator can be simplified. Therefore, an attaching operation of the resonator can be simply performed without any skill.

Since the accommodation space in which the resonator is disposed can be assured readily, and besides, since the attaching operation of the resonator can be simply performed in this manner, exhaust noise can be simply reduced.

Furthermore, since the resonator is bent in a meandering state, even if water should try to enter the resonator from the exhaust pipe side, the water cannot be admitted readily into the inside of the resonator when compared with another resonator which extends linearly.

According to the present invention, the resonator having the flat plate-like configuration extends along a wall face of the watercraft body. Consequently, since a space remaining inside of the watercraft body can be utilized to attach the resonator, the resonator can be further simply attached. Accordingly, exhaust noise of the jet propulsion watercraft can be further simply reduced.

According to the present invention, the resonator can be attached to the outside of the watercraft body by laying the resonator along the ceiling wall of the pump room. A space around the ceiling wall of the pump room remains as a dead space. Therefore, by laying the resonator along the ceiling wall of the pump room, the remaining dead space can be utilized to attach the resonator.

In addition, since the pump room is the outside of the watercraft body, and since the resonator is attached to the outside of the watercraft body, there is no need to assure the accommodation space for accommodating the resonator in the inside of the watercraft body. By laying the resonator along the ceiling wall of the pump room in this manner, the resonator can be further simply attached. Accordingly, exhaust noise of the jet propulsion watercraft can be further simply reduced.

According to the present invention, the exhaust sound of the pump chamber can be insulated by closing the pump chamber with the sound insulating member. Therefore, since a reduction of the sound by insulation of the sound can be anticipated in addition to a reduction of the sound by the resonator, exhaust noise of the jet propulsion watercraft can be further simply reduced.

Incidentally, the pump room is the outside the watercraft body, and the space of the pump room remains as a dead space. By making the most of the dead space, the insulating member can be simply attached. Accordingly, exhaust noise of the jet propulsion watercraft can be further simply reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust structure for a jet propulsion watercraft wherein a water jet propeller is provided in a pump room of a watercraft body and an engine for driving is connected to said water jet propeller, and an exhaust opening of an exhaust pipe attached to said engine is exposed to a pump room comprising:

a resonator for sound deadening, said resonator being operatively connected to said exhaust pipe;

said resonator being bent in a meandering state wherein bent portions thereof are positioned adjacent to each other so that said entire resonator has a substantially flat plate-like configuration.

2. The exhaust structure for a jet propulsion watercraft according to claim 1, wherein said resonator having the flat plate-like configuration extends along a wall face of said watercraft body.

3. The exhaust structure for a jet propulsion watercraft according to claim 2, wherein said wall face of said watercraft body along which said resonator extends is a ceiling wall of said pump room, and an exhaust opening of a communicating pipe extending through said ceiling wall is in communication with said resonator extending along said ceiling wall.

4. The exhaust structure for a jet propulsion watercraft according to claim 1, wherein said resonator includes a first bent portion that is bent by approximately 180° relative to a base portion of the resonator and a first extending portion that extends from said first bent portion along a side of the base portion.

5. The exhaust structure for a jet propulsion watercraft according to claim 4, wherein said resonator includes a second bent portion that is bent by approximately 180° relative to the first extending portion and a second extending portion that extends from said second bent portion along a side of the first extending portion.

6. The exhaust structure for a jet propulsion watercraft according to claim 5, wherein said resonator includes a third bent portion that is bent by approximately 90° relative to the second extending portion and a third extending portion that extends from said third bent portion along a side of the first bent portion and the base portion.

7. The exhaust structure for a jet propulsion watercraft according to claim 4, and further including a first rib formed between said base portion and said first bent portion for providing an integral connection therebetween.

8. The exhaust structure for a jet propulsion watercraft according to claim 5, and further including a second rib formed between said first bent portion and said second bent portion for providing an integral connection therebetween.

9. The exhaust structure for a jet propulsion watercraft according to claim 1, and further including a mounting bracket secured to said resonator for mounting said resonator relative to said watercraft body.

10. The exhaust structure for a jet propulsion watercraft according to claim 1, and further including a projection extending into a space in communication with the exhaust and further including openings formed on each side of said projection for discharging exhaust from said resonator.

11. The exhaust structure for a jet propulsion watercraft according to claim 1, wherein said resonator is secured to said exhaust pipe and formed as a part thereof.

12. The exhaust structure for a jet propulsion watercraft according to claim 3, wherein said water jet propeller and a reverse basket are accommodated in said pump room, and a sound insulating member is provided for both or one of said water jet propeller and said reverse basket such that said pump chamber is closed.

13. An exhaust structure for a jet propulsion watercraft comprising:

a watercraft body;

an exhaust pipe, said exhaust pipe being adapted to be connected to an engine for said watercraft body;

an exhaust opening for said exhaust pipe, said exhaust opening being in communication with an area within said watercraft body; and a resonator for sound deadening, said resonator being operatively connected to said exhaust pipe;

said resonator being bent in a meandering state wherein the bent portions thereof are positioned adjacent to each other so that said entire resonator has a substantially flat plate-like configuration.

14. The exhaust structure for a jet propulsion watercraft according to claim 13, wherein said resonator having the flat plate-like configuration extends along a wall face of said watercraft body.

15. The exhaust structure for a jet propulsion watercraft according to claim 14, wherein said wall face of said watercraft body along which said resonator extends is a ceiling wall of a pump room, and an exhaust opening of a communicating pipe extending through said ceiling wall is in communication with said resonator extending along said ceiling wall.

16. The exhaust structure for a jet propulsion watercraft according to claim 13, wherein said resonator includes a first bent portion that is bent by approximately 180° relative to a base portion of the resonator and a first extending portion that extends from said first bent portion along a side of the base portion.

17. The exhaust structure for a jet propulsion watercraft according to claim 16, wherein said resonator includes a second bent portion that is bent by approximately 180° relative to the first extending portion and a second extending portion that extends from said second bent portion along a side of the first extending portion.

18. The exhaust structure for a jet propulsion watercraft according to claim 17, wherein said resonator includes a third bent portion that is bent by approximately 90° relative to the second extending portion and a third extending portion that extends from said third bent portion along a side of the first bent portion and the base portion.

19. The exhaust structure for a jet propulsion watercraft according to claim 16, and further including a first rib formed between said base portion and said first bent portion for providing an integral connection therebetween.

20. The exhaust structure for a jet propulsion watercraft according to claim 17, and further including a second rib formed between said first bent portion and said second bent portion for providing an integral connection therebetween.

21. The exhaust structure for a jet propulsion watercraft according to claim 13, and further including a mounting bracket secured to said resonator for mounting said resonator relative to said watercraft body.

22. The exhaust structure for a jet propulsion watercraft according to claim 13, and further including a projection extending into a space in communication with the exhaust and further including openings formed on each side of said projection for discharging exhaust from said resonator.

23. The exhaust structure for a jet propulsion watercraft according to claim 13, wherein said resonator is secured to said exhaust pipe and formed as a part thereof.

24. The exhaust structure for a jet propulsion watercraft according to claim 15, wherein said water jet propeller and a reverse basket are accommodated in said pump room, and a sound insulating member is provided for both or one of said water jet propeller and said reverse basket such that said pump chamber is closed.

* * * * *